US006338659B1

(12) United States Patent
Michael

(10) Patent No.: US 6,338,659 B1
(45) Date of Patent: Jan. 15, 2002

(54) TERMINAL STRIP FOR MAKING COMPLIANT TERMINALS

(75) Inventor: Jeffrey Michael, Middlefield, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/867,860

(22) Filed: May 30, 2001

(51) Int. Cl.[7] ..... H01R 13/02
(52) U.S. Cl. ..... 439/885; 29/879
(58) Field of Search ..... 439/885, 246; 29/845, 879

(56) References Cited

U.S. PATENT DOCUMENTS 3,795,889 A * 3/1974 Nauman et al. ..... 439/885
6,083,060 A * 7/2000 Chen et al. ..... 439/885

* cited by examiner

*Primary Examiner*—Paula Bradley
*Assistant Examiner*—Briggitte R. Hammond
(74) *Attorney, Agent, or Firm*—Thomas A. Twomey

(57) ABSTRACT

An elongated terminal strip has a series of terminals, each having a compliant portion engaged laterally between a first and second portion which electrically engage to respective electrical components having a tendency to vibrate. Each compliant portion extends longitudinally with respect to the terminal strip between two adjacent cut lines. A plurality of leading and trailing slots extend longitudinally within the compliant portions and are disposed alternately through one then the other adjacent cut lines. The step of dispensing or cutting the terminal away from the terminal strip exposes the slots along the cut edge enabling the flexing capability of the compliant portion.

15 Claims, 2 Drawing Sheets

TERMINAL STRIP FOR MAKING COMPLIANT TERMINALS

TECHNICAL FIELD OF THE INVENTION

This invention relates to a terminal strip for making terminals and more particularly to terminals having a compliant portion and to a method for making such.

BACKGROUND OF THE INVENTION

A terminal is known to electrically interconnect one electrical component to another through a pressure fitted electrical connection at either or both ends. The terminal is typically made of a cost effective tin plated copper alloy providing a reliable electrical connection. When making or breaking the electrical connection, the tin oxide layer of the terminal essentially cracks permitting clean tin to ooze out through the crack. The clean tin bonds to the connector of the electrical component providing a very stable electrical connection Fretting corrosion is a known phenomenon which can cause otherwise stable tin plated copper alloy electrical connections to fail. For fretting corrosion to occur, there must be a small degree of movement or rubbing between the pressure fitted tin plated terminal interface. Such movement is usually the result of vibration from one or both of the electrical components. Fretting or the rubbing of the terminal interface together typically occurs only when the vibration or displacement between components is of a small magnitude measured in microns (i.e. 10–100 microns) and the pressure between the interface is low. Fretting corrosion occurs when the once clean tin is exposed to the air as a result of movement, wherein the tin quickly forms into an electrically insulating tin oxide film. With repeated motions, the debris of tin oxide builds up until the electrical connection fails.

Fretting corrosion can be eliminated by preventing the electrical components from vibrating, or utilizing gold or silver based terminal contact coatings which resist fretting corrosion. Unfortunately, either means may not be practical or may be cost prohibited depending upon the application.

SUMMARY OF THE INVENTION

The present invention provides an elongated terminal strip having a series of terminals and Cut lines disposed therebetween. Each terminal has a compliant portion extending longitudinally with respect to the elongated terminal strip from one laterally extended cut line to the next succeeding cut line. An electrical contact first portion extends laterally outward from the compliant portion between the two adjacent cut lines. An opposing second portion, extends laterally outward from the opposite side of the compliant portion. The first and second portions electrically engage respective electrical components. If either electrical component should vibrate, the compliant portion of the terminal will extend, retract or twist, in other words, will move within a three dimensional array, thereby enabling either the first or second portions of the terminal to move relative to the respective vibrating electrical component preventing any relative movement at the electrical contact points and eliminating fretting concerns.

The compliant portion has at least one slot which extends longitudinally with respect to the elongated terminal strip from either one of the adjacent cut lines to an end of the slot disposed within the compliant portion of the terminal. Preferably, the compliant portions have a plurality of slots which extend from both of the adjacent cut lines. For instance, preferably the compliant portion has a leading slot extended rearward within the compliant portion. The leading slot is disposed between two trailing slot which extend forward within the compliant portion from a succeeding cut line to the cut line communicating with the leading slot. The trailing slots have ends disposed within the compliant portion lying slightly rearward of the cut line communicating with the leading slot. The ends of the trailing slots are disposed laterally outward with respect to the leading slot.

A feature of the present invention is the reduction of fretting corrosion caused by vibrating electrical components.

Another feature of the invention is the production of a cost effective and robust compliant portion of the terminal.

BRIEF DESCRIPTION OF THE DRAWINGS

The presently preferred embodiments of the invention are disclosed in the following description and accompanying drawings wherein.

DETAILED DESCRIPTION OF THE PREFERRED EMBODIMENTS

Figure 1:
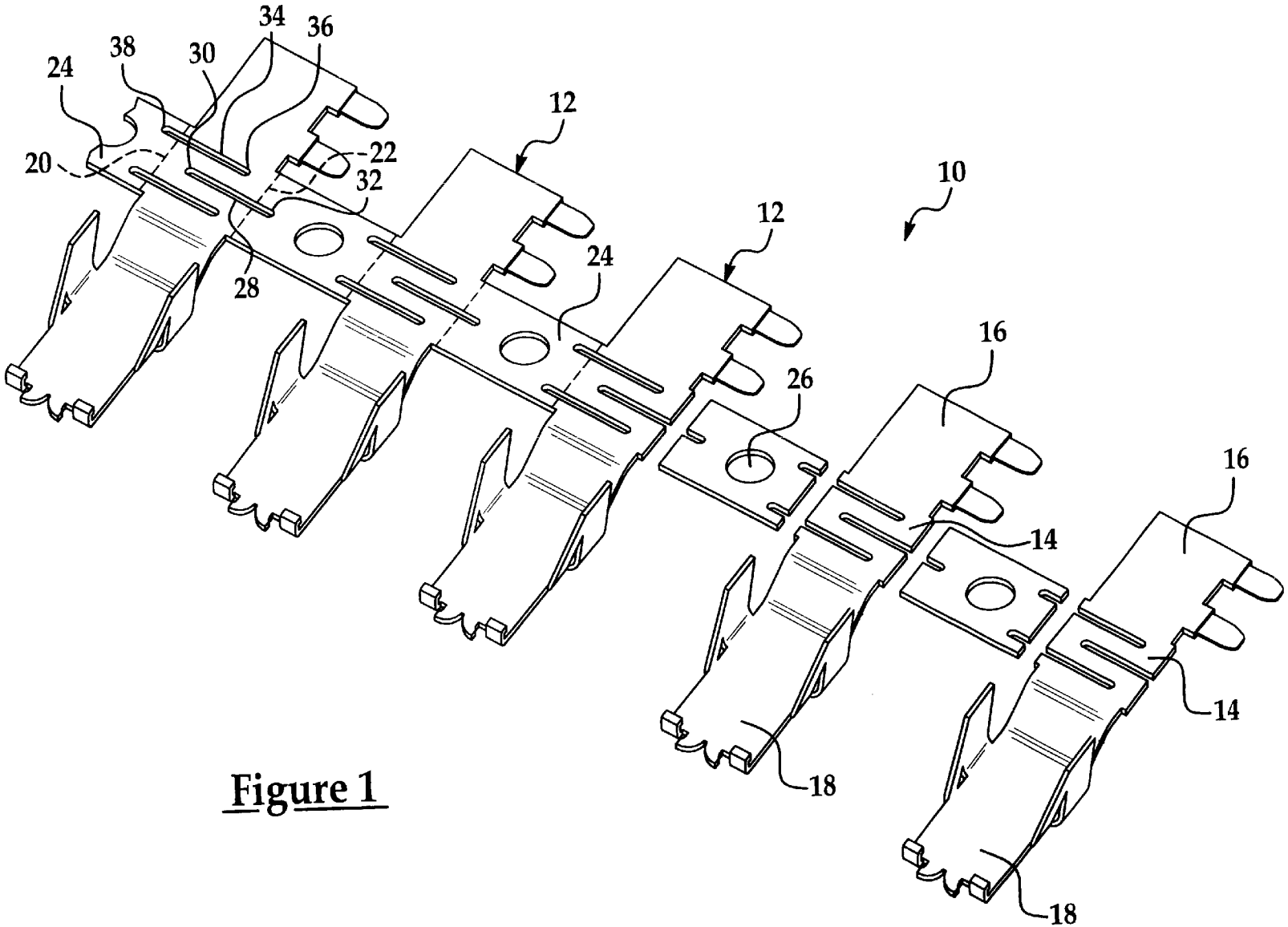
FIG. 1 is a partially exploded perspective view of a terminal strip of the present invention.

Referring to FIG. 1, a terminal strip 10 of the present invention has a series of terminals 12 generally aligned laterally across the longitude of the terminal strip 10. A substantially planar compliant portion 14 is engaged between an electrical contact first portion 16 and an electrical contact second portion 18. The compliant portion 14 extends longitudinally with respect to the elongated terminal strip 10 in a forward direction from a trailing cut line 20 to a leading cut line 22. The compliant portion 14 of the terminal 12 is substantially identical to the next succeeding compliant portion 14 of the next terminal 12 along the terminal strip 10. Interconnecting each terminal 12 along the terminal strip 10 are a series of connecting portions 24. Each connecting portion 24 extends rearward from the trailing cut line 20 of one terminal 12 to the leading cut line 22 of the next succeeding terminal 12. The connecting portion 24 has an indexing hole 26 which receives a protrusion from a manufacturing cutting machine (not shown) to align the terminal strip 10 prior to cutting the terminal 12 off from the terminal strip 10 along the trailing and leading cut lines 20, 22. After the terminals 12 are formed and cut, the cut connecting portion 24 becomes scrap material.

Providing the flexibility within the compliant portion 14 of the terminal 12 is a leading slot 28. Leading slot 28 extends rearward from the leading cut line 22 and longitudinally with respect to the terminal strip 10. The leading slot 28 has an end 30 disposed within the compliant portion 14 slightly forward of the trailing cut line 20 and an opposite end 32 disposed either on the leading cut line 22 or slightly within the connecting portion 24 disposed adjacent to and forward of the compliant portion 14. Providing additional flexibility of the compliant portion 14 are preferably two longitudinally extended tailing slots 34. The trailing slots 34 extend forward from the trailing cut line 20 and longitudinally with respect to the terminal strip 10. Each trailing slot 34 has an end 36 disposed within the compliant portion 14 slightly rearward of the leading cut line 22 and an opposite end 38 disposed either on the trailing cut line 20 or slightly within the connecting portion 24 disposed adjacent and rearward of the compliant portion 14.

A major portion of the leading slot 28 contained within the compliant portion 14 is disposed substantially between the two trailing slots 34. The two ends 36 of the trailing slots 34 are disposed laterally outward from and on either side of the leading slot 28. The leading slot 28 and the trailing slots 34 are substantially parallel to one another. The configuration of the leading and trailing slots 28, 34 provide a three dimensional flexing capability of the compliant portion 14. In other words, the electrical contact first portion 16 may move toward or away from the contact second portion 18 of the terminal 12 as a result of electrical component vibrations. Similarly, the first and second portions 16, 18 may twist, move side to side, or move up and down with respect to one another. This flexibility of the compliant portion 14 ensures that the electrical contact points of the first or second portions 16, 18 and the respective electrical components do not rub as a result of component vibration. In this way, fretting, corrosion is avoided or at least reduced. Increasing the number of alternating trailing and leading slots 34, 28, or increasing the lengths of the slots within the compliant portion 14 can further enhance the flexing capability of the terminal 12 if the need is required.

During the manufacturing process, the terminal strip 10 is pre-stamped, containing all of the leading and trailing slots 28, 34 and indexing holes 26 previously described. The step of cutting the connecting portion 24 away from the leading end of the terminal strip 10, along the leading cut line 22, cuts off the opposite end 32 of the leading slot 28 exposing the leading slot 28 along the cut edge of the compliant portion 14, as shown in FIG. 1. Likewise, the step of cutting the terminal 12 away from the subsequent leading end of the terminal strip 10, along the trailing cut line 20 leaves the opposite ends 38 of the trailing slots 34 behind within the next succeeding connecting portion 24 of the terminal strip 10. The trailing slots 34 of the separated terminal 12 are now exposed through the opposite cut edge of the compliant portion 14. In essence, the act of cutting or dispensing the terminals 12 from the terminal strip 10 creates or enables the flexibility of the compliant portion 14.

Figure 2:
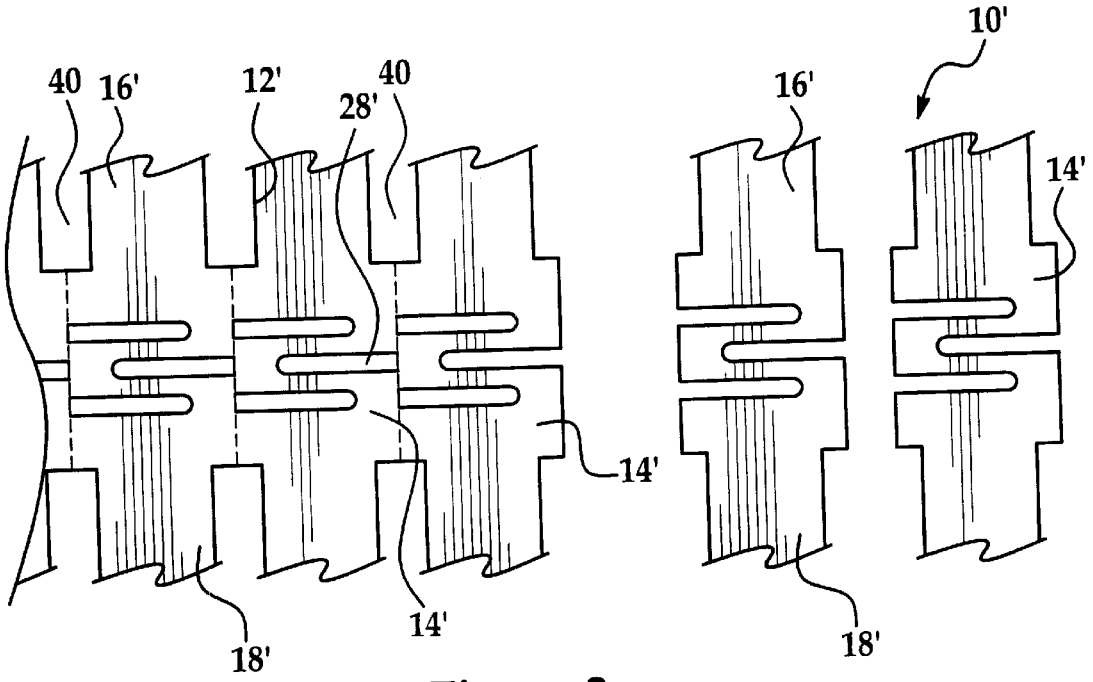
FIG. 2 is a partially exploded perspective view of a second embodiment of a terminal strip of the present invention.

Referring, to FIG. 2, a second embodiment of the present invention is illustrated wherein the connecting portions 24 of the first embodiment are eliminated so that the compliant portions 14' of the terminals 12' are end to end or juxtaposed. The terminal strip 10' of the second embodiment is indexed within the manufacturing cutting machine utilizing any one of the trailing or leading slots 34', 28' as the indexing hole 26 of the first embodiment. The trailing cut line 20 and the next succeeding or trailing, cut line 22 of the first embodiment coincide in the terminal strip 10' of the second embodiment, forming a singular common cut line 40. The terminal 12' extends from cut line 40 to the next succeeding common cut line 40. The leading slot 28' extends rearward from the cut line 40 into the compliant portion 14'. The trailing slots 34' extend forward from the next succeeding common cut line 40. The leading and trailing slots 28', 34' have the same configuration within the compliant portion 14' as previously described for the terminal strip 10 of the first embodiment.

Figure 3:
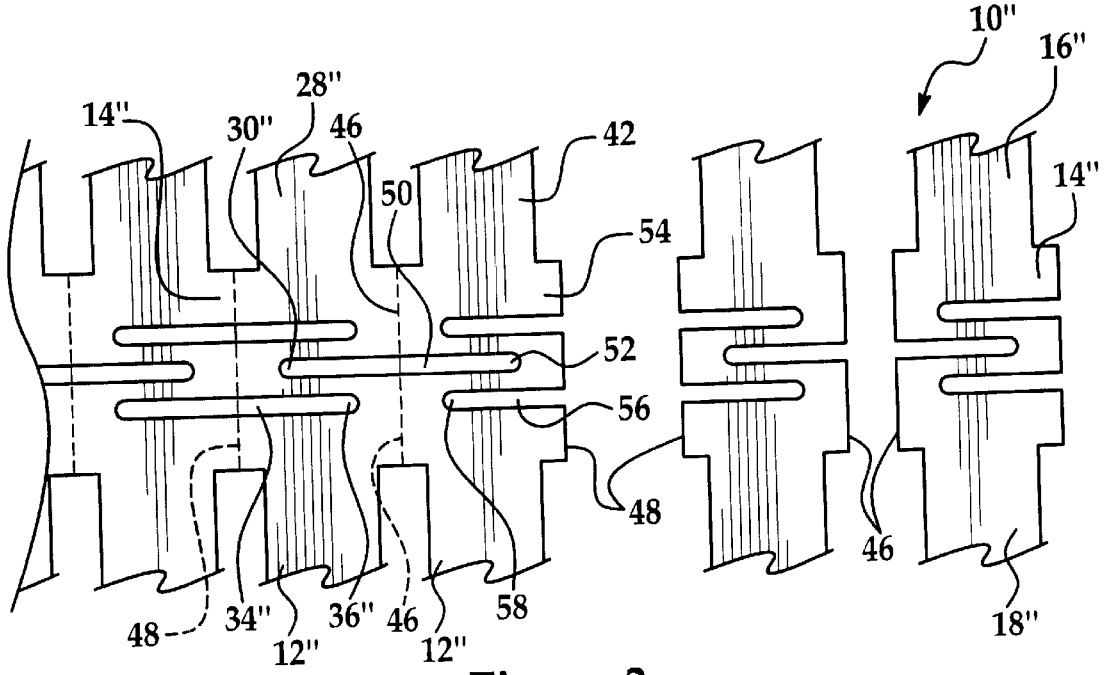
FIG. 3 is partially exploded perspective view of a third embodiment of a terminal strip of the present invention.

Referring to FIG. 3, a third embodiment of the present invention is shown. Unlike the first and second embodiments where the terminals 12 or 12' are identical, the series of terminals 12" of the terminal strip 10" comprise alternating leading and trailing terminals 42, 44. Although not identical to one another as are the terminals 12' of the second embodiment, the leading terminal 42 of the third embodiment is substantially a mirror image of the trailing terminal 44. The leading terminal 42 extends rearward along the terminal strip 10" from a second cut line 48 to a first cut line 46. The trailing terminal 44 is disposed adjacent to the leading terminal 42 and extends rearward from the first cut lie 46 to the next succeeding second cut line 48.

The leading terminal 42 has a trailing slot 50 which extends forward from the first cut line 46 to an end 52. The end 52 of the trailing slot 50 is disposed within the compliant portion 54 slightly rearward of the respective second cut line 48. The leading terminal 42 preferably has two leading slots 56 disposed on either side of the trailing slot 50. The leading slots 56 extend rearward from the second cut line 48 to respective ends 58. The end 58 is disposed within the compliant portion 54 slightly forward of the first cut line 46 and laterally outward with respect to the trailing slot 50.

The trailing terminal 44 has the leading slot 28" extending rearward within the compliant portion 14" from the first cut line 46 to the end 30". The end 30" is disposed within the compliant portion 14" slightly forward of the second cut line 48. Furthermore the leading slot 28" of the trailing terminal 44 is collinear to the trailing slot 50 of the leading terminal 42 and communicates with the trailing slot 50 through the first cut line 46. The trailing terminal 44 also has preferably two trailing slots 34" which extend forward from the second cut line 48 within the compliant portion 14" to the end 36" which is disposed slightly rearward from the first cut line 46. Like the first and second embodiments, the leading slot 28" is disposed substantially between the two trailing slots 34". The ends 36" of the trailing slots 34" are disposed laterally outward with respect to the leading slot 28". Each respective trailing slots 34" of the trailing terminal 34 are collinear with the respective leading slots 56 of the leading terminal 42 and thereby communicate through the second cut line 48.

Although the preferred embodiment of the present invention have been disclosed, various changes and modification may be made thereto by one skilled in the art without departing from the scope and spirit of the invention as set forth in the appended claims. Furthermore, it is understood that the terms used herein are merely descriptive, rather than limiting and various changes may be made without departing from the scope and spirit of the invention.

What is claimed is:

1. An elongated terminal strip comprising:

the terminal strip having a plurality of cut lines, each one of the plurality of cut lines extended cross-wise to the terminal strip;

a plurality of terminals, each terminal having a compliant portion extended longitudinally between a pair of two adjacent ones of the plurality of cut lines;

the compliant portion having a slot disposed longitudinally with respect to the terminal strip and extended from one of the two adjacent ones of the plurality of cut lines, the slot having an end disposed within the compliant portion; and an electrical contact first and an electrical contact second portion of each one of the plurality of terminals, the compliant portion disposed between the first and second electrical contact portions, the first and second electrical contact portions engaged to the compliant portion between the pair of two adjacent ones of the plurality of cut lines of the terminal strip.

2. The terminal strip as set forth in claim 1 further comprising:

the plurality of cut lines being a plurality of leading cut lines and a plurality of trailing cut lines, each one of the plurality of leading cut lines alternating in succession with each one of the plurality of trailing cut lines; and a plurality of slots, the slot being one of the plurality of slots, the plurality of slots having a leading, slot extended rearward from the respective one of the plurality of leading cut lines and a trailing slot extended forward from the respective one of the plurality of trailing cut lines, the end of the trailing slot aligned and disposed laterally outward with respect to the leading slot.

3. The terminal strip as set forth in claim 2 wherein the compliant portions of the plurality of terminals are identical.

4. The terminal strip as set forth in claim 3 further comprising:

the plurality of terminals having a leading terminal and a trailing terminal;

an connecting portion disposed between the compliant portion of the leading terminal and the compliant portion of the trailing terminal, the connecting portion having an indexing hole;

the leading slot of the trailing terminal having an opposite end disposed within the connecting portion; and the trailing slot of the leading terminal having an opposite end disposed within the connecting portion.

5. The terminal strip as set forth in claim 3 wherein each one of the plurality of leading cut lines is coincident with each respective succeeding one of the plurality of trailing cut lines forming a plurality of common cut lines, the compliant portion of each one of the plurality of terminals extended rearward from the common cut line to the next succeeding common cut line.

6. The terminal strip as set forth in claim 4 or 5 further comprising two trailing slots the trailing slot being one of the two trailing slots, the leading slot disposed laterally between the two trailing slots.

7. The terminal strip as set forth in claim 1 further comprising:

the plurality of terminals having a plurality of leading terminals and a plurality of trailing terminals, each one of the plurality of leading terminals engaged alternately to each one of the plurality of trailing terminals along the terminal strip;

the plurality of cut lines having a plurality of first cut lines and a plurality of second cut lines, each one of the plurality of leading terminals extended rearward from one of the plurality of second cut lines to one of the plurality of first cut lines, each one of the plurality of trailing terminals extended rearward from one of the plurality of first cut lines to one of the plurality of second cut lines; and a the slot of the compliant portion of each one of the leading terminals being a trailing slot extended forward from each respective adjacent one of the plurality of first cut lines; and the slot of the compliant portion of each one of the trailing terminals being a leading slot extended rearward from each respective adjacent one of the plurality of first cut lines, the trailing slot of each one of the plurality leading terminals being collinear and communicating with the leading slot of each succeeding one of the plurality of trailing terminals.

8. The terminal strip as set forth in claim 7 further comprising:

a plurality of slots of the compliant portion of each one of the leading terminals, the plurality of slots having the trailing slot of the leading terminal and a leading, slot, the leading slot extended rearward from each adjacent one of the plurality of second cut lines, the end of the leading slot disposed laterally outward with respect to the trailing slot; and a plurality of slots of the compliant portion of each one of the trailing terminals, the plurality of slots having, the leading slot of the trailing terminal and a trailing slot, the trailing slot extended forward from each adjacent one of the plurality of second cut lines, the end of the trailing slot disposed laterally outward with respect to the trailing slot, the leading slot of each one of the leading terminals being collinear and communicating with the trailing slot of each preceding one of the plurality of trailing terminals.

9. The terminal strip as set forth in claim 8 further comprising:

the plurality of slots of the compliant portion of each one of the leading terminals having a second leading slot, the trailing slot disposed laterally between the two leading slots; and the plurality of slot s of the compliant portion of each one of the trailing terminals having a second trailing slot, the leading slot disposed laterally between the two trailing slots, the second leading slot of each one of the leading terminals being collinear and communicating with the second trailing slot of each adjacent preceding one of the trailing terminals.

10. An elongated terminal strip comprising:

the terminal strip having a leading cut line extended transversely across the terminal strip;

the terminal strip having a trailing cut line extended transversely across the terminal strip;

a terminal having, a compliant portion, an electrical contact first portion and an electrical contact second portion, the compliant portion engaged laterally between the first and second portions and extended longitudinally rearward from the leading cut line to the trailing cut line, the compliant portion having a trailing slot extended longitudinally forward through the trailing cut line from a trailing end to a leading end, the leading end disposed within the compliant portion; and a trailing connecting portion extended longitudinally rearward from the trailing cut line, the trailing end of the trailing slot disposed within the connecting portion.

11. The terminal strip as set forth in claim 10 further comprising:

a leading connecting portion extended longitudinally forward from the leading cut line; and the compliant portion of the terminal having a leading slot extended longitudinally forward through the leading cut line from a trailing end to a leading end, the trailing end disposed within the compliant portion and laterally outward with respect to the trailing slot, the leading end disposed within the leading connecting portion.

12. The terminal strip as set forth in claim 11 wherein the compliant portion has a second trailing slot, the leading slot extended longitudinally between and laterally inward from the first and second trailing slots.

13. The terminal strip as set forth in claim 12 wherein de leading connecting portion is identical to the trailing connecting portion and wherein each one of the connecting portions have a hole.

14. A method of producing a terminal from a terminal strip comprising the steps of:

forming a terminal strip that includes a terminal having a compliant portion disposed between a leading cut line and a trailing cut line, the terminal having a leading slot and a plurality of trailing slots, the trailing slots extended longitudinally forward from the trailing cut line to respective ends disposed within the compliant portion, the leading slot extended longitudinally between the trailing slots and rearward from the leading cut line to an end disposed within the compliant portion;

cutting a connecting portion away from the terminal strip along the leading cut line and transversely through the leading slot, whereby the leading slot is an open ended slot extended from the closed end to an opposite open end at the leading cut edge; and cutting the terminal away from the terminal strip along the trailing cut line and transversely through the plurality of trailing slots, whereby each one of the plurality of trailing slots is an open ended slot extended from the closed end to an opposite open end at the trailing cut edge.

15. The method of producing a terminal as set forth in claim 14 further comprising the step of advancing the terminal strip by engaging the connecting portion through an indexing hole.

* * * * *

UNITED STATES PATENT AND TRADEMARK OFFICE

CERTIFICATE OF CORRECTION

PATENT NO. : 6,338,659 B1
DATED : January 15, 2002
INVENTOR(S) : Jeffrey Michael Hickox It is certified that error appears in the above-identified patent and that said Letters Patent is hereby corrected as shown below:

Title page,
Item [75], should read as follows:
-- [75] Inventor: Jeffrey Michael Hickox, Middlefield, OH (US) --

Signed and Sealed this

Fourteenth Day of May, 2002

*Attest:*

*Attesting Officer*

JAMES E. ROGAN
*Director of the United States Patent and Trademark Office*